US006126146A

United States Patent [19]

Melton

[11] Patent Number: 6,126,146

[45] Date of Patent: Oct. 3, 2000

[54] CHAIN LINK CONVERSION BLOCK AND PLANK

[76] Inventor: Steve W. Melton, 2601 Saltlake St., North Las Vegas, Nev. 89030

[21] Appl. No.: 08/804,410

[22] Filed: Feb. 21, 1997

[51] Int. Cl.[7] ..... B21F 27/00

[52] U.S. Cl. ..... 256/34; 256/19; 256/24; 256/32

[58] Field of Search ..... 256/1, 19, 22, 256/24, 32, 34, 73, 29, 47, 55, 69

[56] References Cited

U.S. PATENT DOCUMENTS

| | | | |
|---|---|---|---|
| 2,237,669 | 4/1941 | Hilgram | 256/14 |
| 2,785,877 | 3/1957 | Parks | 256/14 |
| 3,913,889 | 10/1975 | Nugent et al. | 256/32 X |
| 4,512,556 | 4/1985 | Meglino | 256/14 |
| 4,582,284 | 4/1986 | Veenstra | 256/32 X |
| 4,860,998 | 8/1989 | Snyder | 256/14 |
| 4,872,647 | 10/1989 | Paradise et al. | 256/32 X |
| 5,007,619 | 4/1991 | Sibeni | 256/14 |
| 5,106,058 | 4/1992 | Finkelstein | 256/14 |
| 5,275,380 | 1/1994 | Barsby | 256/14 |
| 5,421,557 | 6/1995 | Vise | 256/24 |
| 5,441,239 | 8/1995 | Watson | 256/32 X |
| 5,482,256 | 1/1996 | Caron | 256/14 |
| 5,559,080 | 9/1996 | Vise | 256/22 X |

FOREIGN PATENT DOCUMENTS

| | | | |
|---|---|---|---|
| 1255281 | 12/1971 | United Kingdom | 256/32 |
| 2250757 | 6/1992 | United Kingdom | 256/32 |

*Primary Examiner*—Bruce A. Lev
*Attorney, Agent, or Firm*—Patent & Trademark Services; Thomas Zack; Joseph H. McGlynn

[57] ABSTRACT

Fence planks mounted on a supporting existing chain link fence. Each plank two or more rear spaced tapered mounting blocks with predrilled center holes. After inserting the tapered portion of the mounting block into the space between links, the simulated wood planks are placed on the opposite or outside of the supporting chain link fence. Holes are then drilled through the mounting blocks into the in-place plank until visible from the plank's exposed outer front surface. Next, a screw is screwed through the plank's exposed hole into the mount block to hold the plank to the chain link support fence. Planks are held to existing fence poles by drilling and then screwing them directly into the pole without rear mounting blocks. An enlarged rear tapered mounting block portion engages the fence's links to retain the planks to the chain link fence. The plank's may be made of wood or a molded plastic material which simulates the appearance of wooden plank's in grain, shape and color.

5 Claims, 2 Drawing Sheets

CHAIN LINK CONVERSION BLOCK AND PLANK

BACKGROUND OF THE INVENTION

Chain link fences dot the American landscape providing strong and durable fencing for their users. Drawbacks associated with such fencing include; lack of privacy provided by the opened links; little wind protection; and the somewhat drab link displayed appearance. Over the years attempts have been made to aesthetically improve upon the fence's mill or silver link finish by providing for various color ( e.g., green) vinyl coverings over the links. While a visual improvement, these vinyl coverings have not been as much an improvement as one could desire. Others have attempted to solve the disadvantages of chain link fences by either covering one of its sides or by inserting slats in its links. These attempts have proven somewhat successful, however, none supplies the degree of success afforded by this invention.

The present invention not only provides for the visual improvement of an existing chain link fence by providing for an overlay simulating a wooden plank fence but also does so at a low cost by utilizing the existing chain link fencing as the support structure.

DESCRIPTION OF THE PRIOR ART

Fencing made of different materials and methods has long been known. For example, the U.S. Pat. No. 2,237,669 to Higman discloses a fence construction and method with prefabricated parts having wire tension members secured to posts with a notched block placed over the wire. Pickets are placed within the block's notches as stated.

In the Parks invention (U.S. Pat. No. 2,785,877) a continuous web of woven-like material, such as a bamboo surface covering, is applied over one face of a chain link fence and tied thereto by wire knots.

The existing chain link fence in the Meglino patent (U.S. Pat. No. 4,512,556) has parallel inserted slats with apertures and connecting members to lock the slats to the fence.

A similar invention is disclosed in the Snyder patent (U.S. Pat. No. 4,860,998) wherein slats are inserted into channels of a wire mesh fencing fabric of chain link fence.

In U.S. Pat. No. 5,007,619 to Sibeni a chain link fence has top and bottom horizontal channels with lock tabs into which slats can be placed. Parallel slats having extending wing portions are inserted in the chain link fence disclosed in the Finkelstein patent (U.S. Pat. No. 5,106,058) and retained by a flexible belt.

The Barby patent (U.S. Pat. No. 5,275,380) describes improved corrugated slats inserted through a chain link fence having raised retaining tabs. And in U.S. Pat. No. 5,482,256 to Caron a slat system in mounted in a chain link fence having an elongated slat-retaining member woven through the links of the fence. Arrow-shaped extension on the slats interlock with slotted walls of slat-retaining members to grip the slats. The present invention differs from these invention s and the known prior art by providing for a plurality of fence planks which are held to shaped retaining plugs to hold the planks to one side of a chain link fence as further described in this specification.

SUMMARY OF THE INVENTION

This invention relates to vertically disposed fence planks mounted on a supporting chain link fence. Each plank is held to tapered rear mounting blocks by fasteners extending through the block and plank. After placing the planks on the outside of the supporting chain link fence, the blocks are inserted through the fence's links to engage the planks. Predrilled pilot holes in the blocks permit drilling into the planks and the insertion of screws to hold the members together. An enlarged rear block portion beyond its tapered link insert portion engages the fence links to position the planks on the chain link fence.

It is the primary object of the present invention to provide for an improved apparatus to convert a chain link fence such it will appear like a wooden plank fence.

Another object is to provide for such an apparatus wherein the applied planks are easily installed and made of a weather resistant material attached to mounting blocks.

These and other objects and advantages of the present invention will become apparent to readers from a consideration of the ensuing description and the accompanying drawings.

DESCRIPTION OF THE PREFERRED EMBODIMENT

Figure 1:
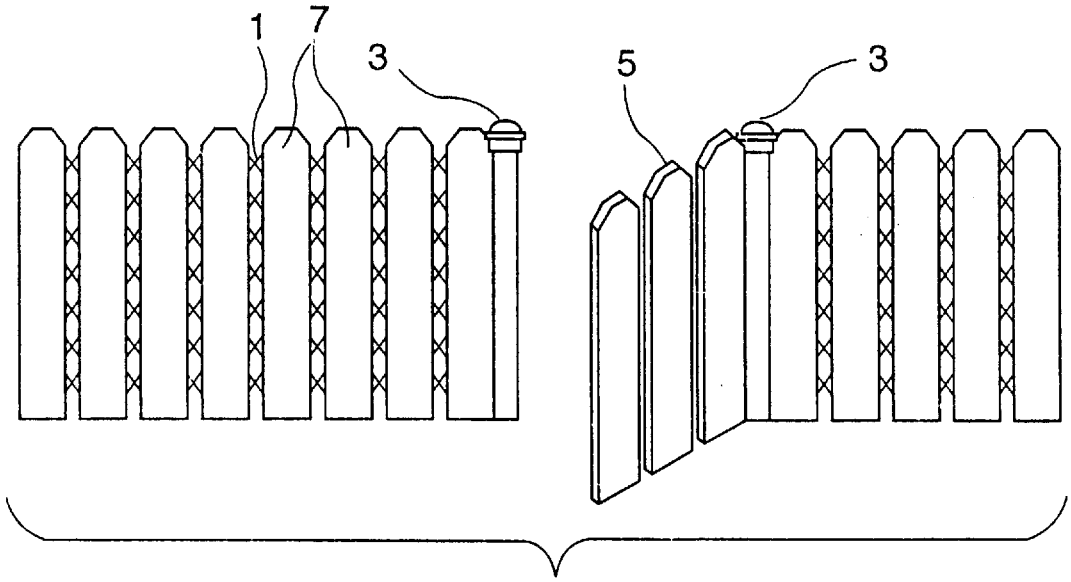
FIG. 1 is a front view of the invention's preferred embodiment after it has been installed over an existing chain link fence.

FIG. 1 is a front view of the invention's preferred embodiment after it has been installed over an existing conventional chain link fence 1. This chain link fence has upright spaced posts 3 usually fixed to the ground by concrete filled holes. Extending between these spaced posts are stretched chain links attached to the posts by twisted wire fasteners. One or more gates 5 mounted with hinges to some of the posts allow users to enter and exit from the fenced-in area. In the preferred embodiment a series of vertically disposed spaced planks 7 oriented generally parallel to each other are mounted on the outside of the supporting existing chain link fence 1. These same planks may also be attached to an existing gate 7 or a new gate with the plank edging touching each other may be used in place of the existing chain link gate.

Figure 2:
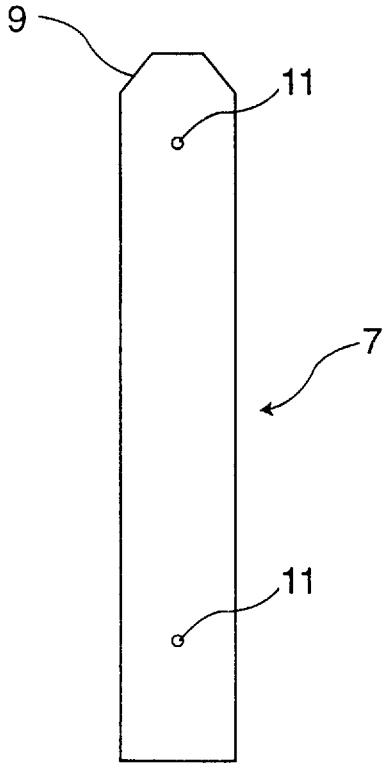
FIG. 2 is a front view of one of the fence planks used in the FIG. 1 embodiment.
Figure 3:
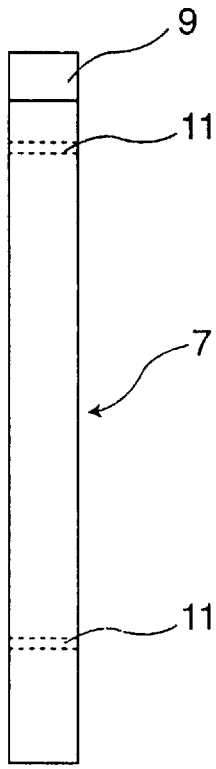
FIG. 3 shows a side view of the FIG. 2 plank.

FIG. 2 is a front view of one of the fence planks 7 used in the FIG. 1 embodiment. The plank may be made of any hard durable material including wood or molded plastic material. Molded plastic may be hollowed out in its interior to reduce cost and weight. When made from a material other than wood the plank may have its shape and surface configured with a grain and colored to resemble wood or any desired decorative appearance. Typically the planks would be made of varying heights (e.g., three, four or six feet) with slanted upper surface edges 9 to divert and prevent the accumulation of rain and snow on them. FIG. 3 shows a side view of the FIG. 2 plank 7. Each plank is held to the existing chain link fence by two or more fasteners which extend through center predrilled holes 11 the mounting block 13 as shown in FIGS. 4–5.

Figure 4:
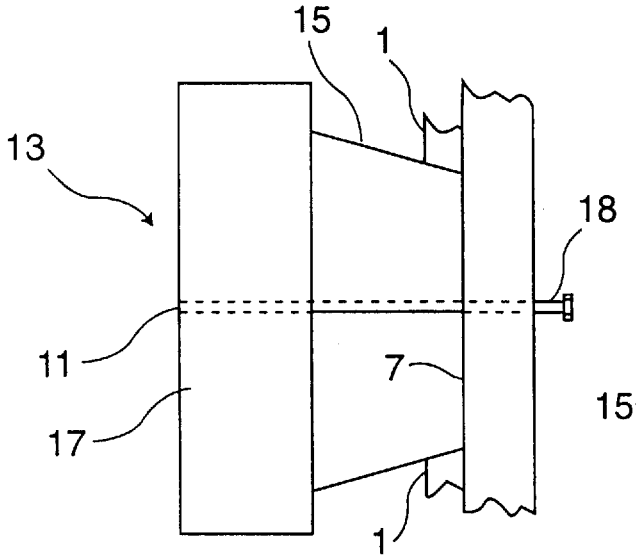
FIG. 4 shows a side view of mounting block.
Figure 5:
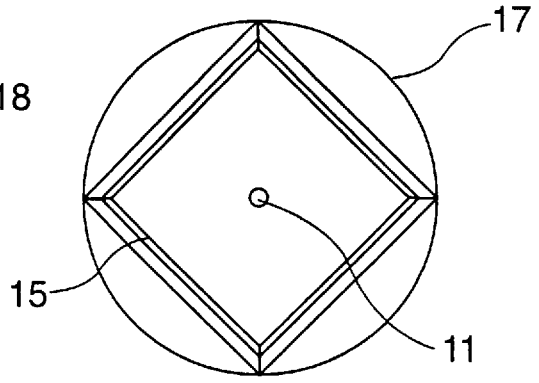
FIG. 5 shows a rear view of the FIG. 4.

FIG. 4 shows an enlarged side view of this retaining and mounting block 13. The front block section or portion 15 is tapered on its four side to fit into the spacing between the chain links of the existing support fence. By using a tapered side variations in spacing between the chain links can be accommodated as the plug is inserted. The rear block portion 17 is circular and larger in diameter and dimensioned such that it is considerably larger than the distance between adjacent links of the chain link fence 1 on which mounted. In this particular illustrated embodiment, the portion 15 is square with its corner edges oriented vertical and horizontal while the portion 17 is circular. Other shapes could be used for the front tapered portion 15 and the enlarged rear portion 17. FIG. 5 shows a rear view of the FIG. 4 to better illustrate the square tapered shape of the smaller insertable section 15 and the larger circular retaining section 17.

To retain a plank to an existing chain link fence 1, a drill bit is inserted into block pilot hole 11 and drilled through it into the in-position mounting block 13 until it engages the back of the held-in-place front plank 7. Drilling is continued into the plank until the bit's front location is sightly visible on the plank's exposed outer surface. Next, a screw 18 is inserted into the plank's exposed hole and into the block's predrilled smaller diameter hole and screwed into both members to hold them together. At least two vertically spaced mounting blocks are used to hold each plank to the existing fence 1 in this manner usually starting near the top of the plank and working down on it.

Preferably the material used to make the blocks 13 should be the same as the planks 7 and should be durable and weather resistant. Molded plastic material has been used and has worked well for this purpose. Cedar and other weather resistant woods and materials may also be used.

Figure 6:
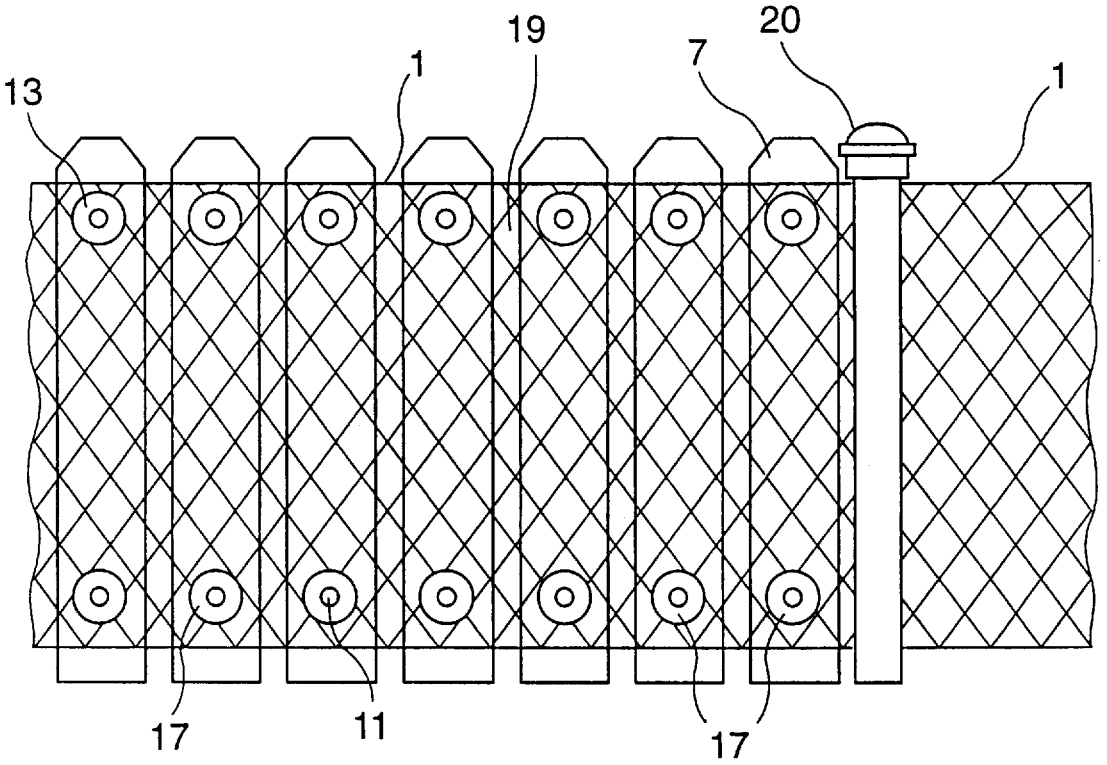
FIG. 6 shows a rear view of the partially installed FIG. 1 plank fencing.

FIG. 6 shows a rear view of the FIG. 1 plank fencing installed over a portion of the existing chain link fence 1. The vertical parallel planks 7 are spaced about ½ inch apart from each other with the larger rear block section 17 seen extending over the chain link edges of the squares 19 formed by these links. Thus, the fence's existing square links 19 are dimensioned to be less on each side than the diameter of the mounting block's outer engaging overlapping section 17.

To install the planks 7 over an existing chain link fence 1 one merely needs to position the planks on the outside of the fencing and then sequentially screw through them after drilling through the rear in-place mounting blocks' predrilled holes 11 from the opposite side of the fence. A spacer and level may be used to insure the proper horizontal spacing and vertical orientation is maintained between adjacent planks. The planks and retaining blocks can be produced in a variety of colors to suit a user's preference and have varying colors of wood grain, pastel colors to match a housing exterior color, etc. Making the planks out of a material which will prevent paint from adhering to its surface will prevent unattractive and often disparaging graffiti from being applied.

When mounting the planks near an existing chain link fence pole 20 skip a plank to space it for the next plank. After all other planks are mounted, go back to where the plank was skipped and drill through the plank right from its front side into the pole 20 starting near its top and then lower down. Screws are then used to hold the planks directly to the pole by inserting them into the plank's drilled holes. Holding planks to existing poles does not require a back mounting block.

Plastic injection molding could be used to make the planks 7 and their blocks 13. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the planks and their mounting blocks). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's planks and mounting blocks cost effectively.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for converting the appearance of an existing chain link fence into a wood appearing planked fence comprising in combination:

an existing chain link fence having opened spaces between adjacent links of the fence, said chain link fence forming a plank support system;

a plurality of vertically disposed spaced plastic fence planks adapted to be mounted on said plank support system, each of said fence planks have upper slanted surface edges and vertical outer surfaces that simulate the appearance of a wooden fence in both surface grain and color;

at least two mounting members for each of said planks, each of said mounting members having larger cross sectional outer sections and smaller cross sectional inner sections, said inner sections being capable of being inserted into the opened spaces between adjacent links of the existing chain link plank support system; and fastener means for mounting said mounting members to said planks and the support system when said mounting members inner sections are inserted into the opened spaces formed between chain links whereby said planks are held to existing support system by the mounting members and fastener means.

2. The invention as claimed in claim 1, wherein said mounting members having preformed fastener guides therein, said preformed fastener guides extending through their outer and inner sections and adapted to receive said fastener means.

3. The invention as claimed in claim 2, wherein said fastener means includes screws which fit into predrilled holes forming the preformed fastener guides, said screws being inserted from the plank's side after a hole is drilled through the mounting member into the plank to form a visible front plank exposure.

4. The invention as claimed in claim 1, wherein said mounting members' inner sections are tapered with the larger cross sectional taper portion where the inner section joins the outer section.

5. The invention as claimed in claim 4, said planks and mounting members are made of a molded plastic material.

* * * * *